United States Patent [19]

Dale

[11] 4,359,792

[45] Nov. 23, 1982

[54] CRIB

[76] Inventor: Clara M. Dale, P.O. Box U, Red Bank, N.J. 07701

[21] Appl. No.: 113,097

[22] Filed: Jan. 17, 1980

[51] Int. Cl.[3] ..... A47D 7/01; A47D 7/02; A47C 29/00

[52] U.S. Cl. ..... 5/100; 5/98 R; 5/414; 135/5.1

[58] Field of Search ..... 5/97, 98 R, 99 R, 100, 5/108, 414, 416, 93 R, 11; 135/5.1, DIG. 1

[56] References Cited

U.S. PATENT DOCUMENTS

| | | | |
|---|---|---|---|
| 1,157,610 | 10/1915 | Barton | 5/93 |
| 1,211,762 | 1/1917 | Sawyer | 5/97 |
| 1,418,541 | 6/1922 | Demlinger | 5/97 |
| 2,699,794 | 1/1955 | Potter | 5/414 |
| 2,783,481 | 3/1957 | Moriarty | 5/97 |
| 3,044,078 | 7/1962 | Hamilton | 5/100 |
| 3,273,862 | 9/1966 | Miller | 5/99 C |
| 3,437,375 | 4/1969 | Kettler | 5/98 R |
| 3,634,894 | 1/1972 | Harbison | 5/100 |
| 3,802,003 | 4/1974 | Lauretti | 5/108 |
| 3,848,278 | 11/1974 | Propst | 5/100 |
| 3,900,907 | 8/1975 | Mulder | 5/93 |
| 4,043,349 | 8/1977 | Gays et al. | 5/97 |

*Primary Examiner*—Alexander Grosz
*Attorney, Agent, or Firm*—Kenyon & Kenyon

[57] ABSTRACT

The crib is formed of walls of mesh in order to eliminate a multiplicity of rigid vertical bars. In addition, a hemispherically shaped canopy of similar mesh structure is fitted to the crib. This canopy has sections which can be pivoted to an open position to obtain access to the crib.

23 Claims, 7 Drawing Figures

CRIB

This invention relates to a crib. More particularly, this invention relates to a crib for infants.

As is known, various types of cribs have been used for infants. In one well known type of construction, the crib is constructed with a pair of end frames and a pair of side frames each of which can be moved vertically via suitable mechanisms to provide access to the crib. Usually, the end frames are provided with flat end boards while the side walls are constructed in a bar-like manner. That is, each side wall has a series of spaced apart vertical bars. However, such a crib construction provides a hazard to infants. For example, a sleeping infant may roll over and impact against the vertical bars to such an extent as to cause injury. In order to overcome this, use is frequently made of a crib bumper. This is usually a pad which runs along the interior perimeter of the crib and is attached to the crib by tieing the pad via ties to the crib bars. However, in addition to the additive process which the bumpers represent, the ties of the bumper are capable of being chewed and swallowed, especially by a teething infant.

Generally, the vertical bars of the above type crib construction are spaced apart a sufficient distance to prevent an infant from wedging itself between the bars. However, in some cases, it is possible for an infant to actually accomplish this. Further, infants generally grasp the bars when attempting to stand up within the crib. Should the infant, standing on wobbly legs, fall, there is the danger that the infant would strike a rigid bar and thus incur injury.

Further, although the thoughts of a pre-verbal infant are not known for certain, it may be supposed that the prison-like appearance of the rigid bars of a standard crib may impose some effect on the infant.

In addition to the above disadvantages of the usual crib construction, it is known that infants frequently attempt to climb out of or into their cribs. If the infant is unsuccessful, a fall may lead to severe injury. It is also known that household pets may frequently attempt to climb into an infant's crib.

Accordingly, it is an object of the invention to provide a crib construction which avoids the use of rigid bars.

It is another object of the invention to provide a crib construction which can be easily covered to prevent an infant from climbing out of or into the crib.

It is another object of the invention to reduce the risk of injury to an infant sleeping in a crib due to the construction of the crib.

It is another object of the invention to eliminate the need for separate crib bumpers for a crib.

Briefly, the invention provides a crib which is comprised of a pair of upstanding end wall sections and a pair of upstanding side wall sections with each side wall section including a rectangular frame and a mesh disposed across and within the frame. By using a mesh, for example of a plastic, such as nylon, rigid bars are eliminated. In addition, each of the end wall sections may also be made in a similar manner i.e. with a rectangular frame and a mesh disposed across and within the frame.

The end wall sections and side wall sections are sized to define an enclosure of suitable size for receiving a mattress and an infant therein. To this end, the end wall sections can be provided with suitable means for the mounting of a mattress frame therein. Also, each end frame can be provided with a suitable means to slidably receive one end of each side wall therein so as to permit vertical movement of the side walls relative to the end frames in a conventional manner.

In accordance with the invention, the crib is also provided with a canopy which is mounted on and between the end wall sections over the crib enclosure so as to preclude an infant from climbing into or out of the crib. In addition, the canopy has at least one movably mounted section which is movable from a closed position to an open position in order to provide access to the enclosure. This moveable section is formed of a curved or arch-shaped frame and a mesh disposed across and within the frame. Still further, the canopy has a pair of end frames in which the moveable section is mounted. Each of these end frames is, in turn, removably mounted on a respective end wall section of the crib and each has a frame to conform with the shape of the frame of the moveable section and a mesh disposed across and within the frame.

The canopy is secured to the end wall sections by suitable means. In this regard, the means may be in the form of a releasable locking means which can be opened to permit removal of the canopy from the end wall sections of the crib. Likewise, the moveable section of the canopy can be provided with a releaseable locking means in order to secure this section to at least one of the end frames.

The construction of the crib with the canopy thereon is such that an infant within the crib can be viewed from any angle through the various meshes. Further, once the infant is inside the crib, the canopy can be closed so that the risk of the infant falling out of the crib is reduced.

The crib construction can be made of suitable materials, for example the frames can be made of plastic so as to be readily molded in a relatively inexpensive manner. As such, the frames are of relatively light weight construction while, at the same time, being of sufficient rigidity and strength to contain an infant.

In use, in order to place an infant within the crib, the moveably mounted canopy section is moved into an open position. At this time, the infant can then be deposited into the crib. Thereafter, the canopy can be returned to the closed position and locked.

Since the mesh provides a resilient flexible surface, there is no need for crib bumpers. Further, should the infant fall against the walls of the crib, the flexible mesh provides a surface which is able to absorb the impact of the infant rather than being a rigid structure.

The various frames of the crib can be made of any suitable material such as a molded plastic. Further, the mesh which is used may be of any suitable non-toxic material which is of sufficient strength to retain an infant within the crib.

In order to secure a mesh in place, a means such as a vinyl strip is placed about the frame and the nylon mesh is inserted between overlapping edges of the vinyl strip so as to form a "sandwich" which can then be stitched. In this regard, the vinyl strip is not disposed over the corners of the frame. Instead, the strip is formed so as to leave gaps between the vinyl and the corners of the frame. When in place, the nylon mesh is in a stretched taut condition so as to give a drum-like effect.

In order to mount the side wall sections on the end wall sections, use is made of any suitable hardware, for example of known construction using vertical side rails so that the sidewall sections can be raised and lowered in a conventional fashion.

These and other objects and advantages of the invention will become more apparent from the following detailed description and appended claims taken in conjunction with the accompanying drawings in which:

Figure 1:
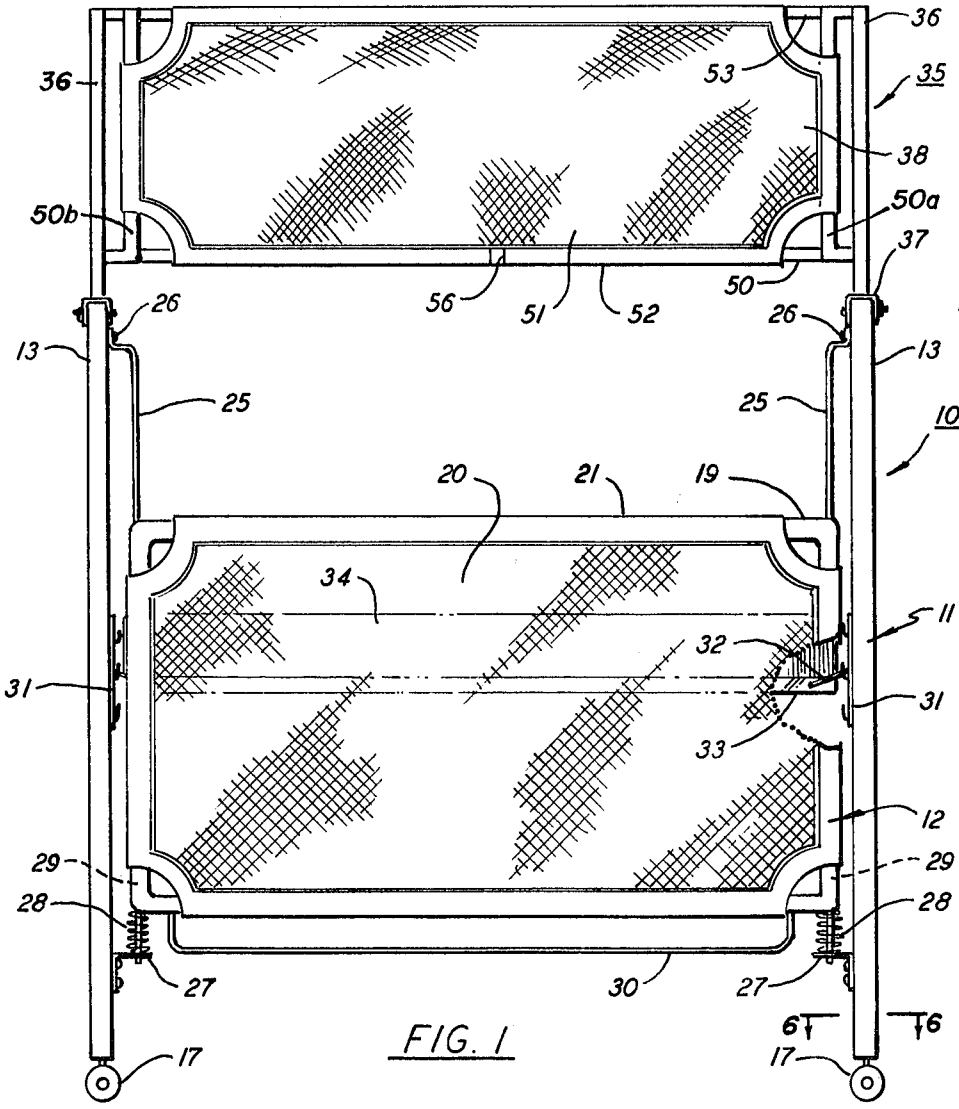
FIG. 1 illustrates a side view of a crib constructed in accordance with the invention.

Referring to FIG. 1, the crib 10 is comprised of a pair of end wall sections 11 and a pair of side wall sections 12 which are mounted between the end wall sections 11 in an upstanding manner to define an enclosure therewith.

Figure 2:
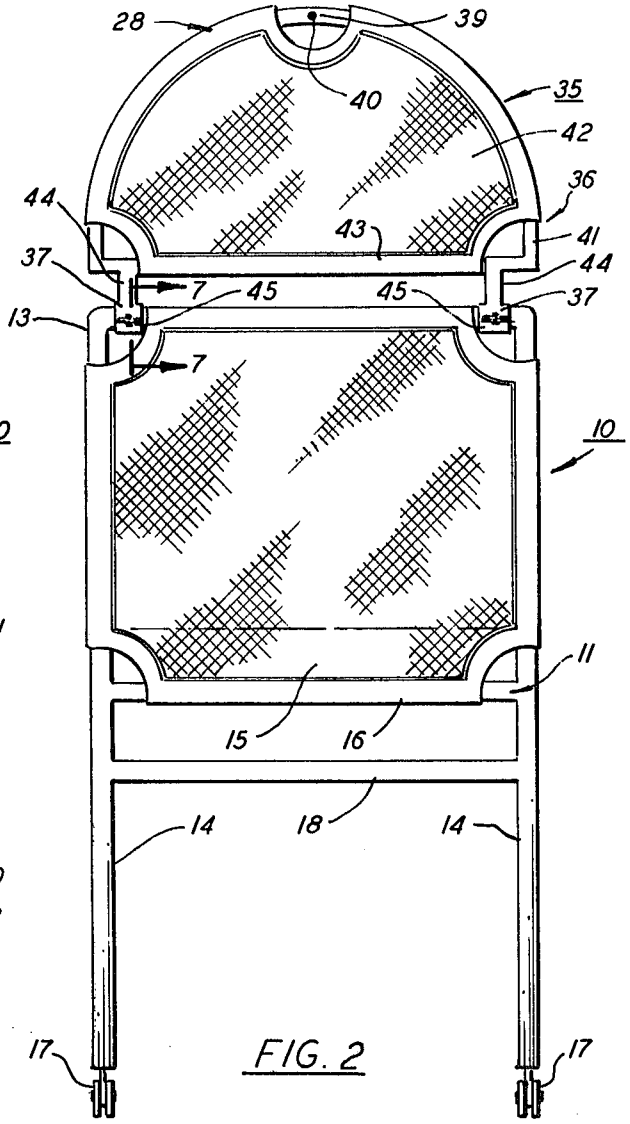
FIG. 2 illustrates an end view of the crib of FIG. 1.

The end wall sections 11 are of identical construction and, as shown in FIG. 2, each includes a rectangular frame 13 and a pair of legs 14 which support the end wall section 11 in an upstanding manner. As indicated, the legs 14 are integral with the frame 13. In addition, each end wall section 11 has a mesh 15 disposed across and within the frame 13. To this end, a suitable means, such as a vinyl strip 16, is provided for securing the mesh 15 to the frame 13 in a taut manner. As shown, the vinyl strip 16 is disposed about four sides of the frame 13 while leaving the corners of the frame 13 exposed.

Each leg of an end section 11 also has a dual wheel assembly 17 mounted on the lower end to permit rolling of the crib 10 from place to place. Also, a bar 18 extends horizontally between the legs 14, for example for suspending accessories therefrom. As indicated, the bar 18 is integral with the legs 14.

Figure 3:
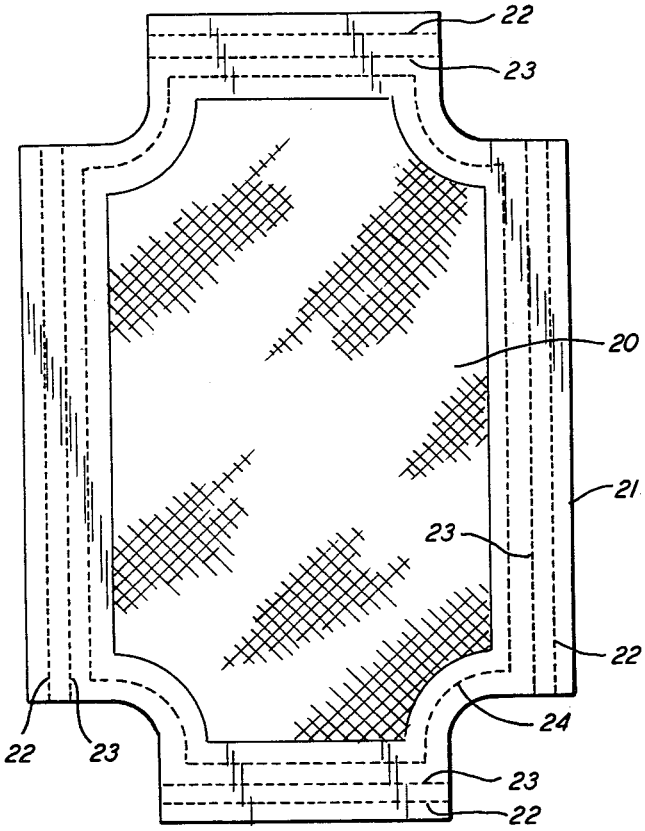
FIG. 3 illustrates a mesh and vinyl strip for forming a wall of the crib in accordance with the invention.
Figure 4:
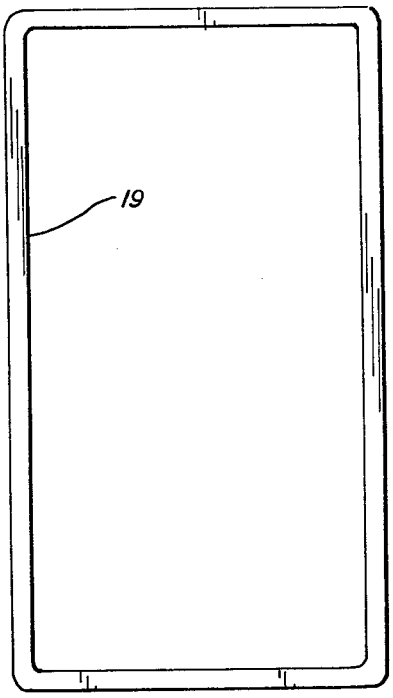
FIG. 4 illustrates a typical frame of the crib in accordance with the invention.

Referring to FIG. 1, each side wall section 12 is of similar construction to an end wall section 11 in having a frame 19 and a mesh 20 disposed across and within the frame 19. Suitable means such as a vinyl strip 21 is also provided for securing the mesh 20 to the frame 19. More specifically, as shown in FIG. 4, the frame 19 is of rectangular construction and is made, for example from a molded plastic bar-like material. As shown in FIG. 3, the mesh 20 is of any suitable non-toxic material for example, the mesh 20 may be made of a Nylon which has sufficient strength for the purposes intended. In order to secure the mesh 20 to the frame 19, the vinyl strip 21 is placed about the frame 19 and the mesh 20 inserted between the overlying edges of the strip 21. This forms a sandwich of material, i.e. vinyl-mesh-vinyl. This sandwich can then be stitched to secure the mesh 20 in place. For example, two parallel lines 22, 23 of stitching may be formed in each of the four edges of the strip 21 to form a sleeve about a respective side of the frame 19. A further continuous line of stitching 24 is then formed to stitch the sandwich of vinyl strip 21 and mesh 20 together. As shown in FIG. 1, the strip 21 is not disposed about the corners of the frame 19 and leaves gaps, for example of about $2\frac{3}{8}$ inches at each corner.

The end wall sections 11 are made in a similar manner and need not be further described.

Referring to FIG. 1, each end section 11 is provided with suitable hardware for mounting the side wall sections 12 in a vertically movable manner. For example, as indicated, each end wall section 11 is provided with a pair of slide bars 25 each of which is secured at the top by a bolt 26 which threads into the frame 13, a pair of brackets 27 mounted on a lower end of the wall section 11 (i.e. on each leg 14) to slidably receive the lower end of a slide bar 25 and a spring 28 about each slide bar 25 and resting on each bracket 27. As shown, the frame 19 of each side wall section 12 is provided with a bore 29 which extends through a side of the frame 19 so as to receive and slide on a respective slide bar 25 as well as a slot (not shown) at the upper end in order to accomodate the upper horizontal part of a slide bar 25. Thus, each side wall section 12 can be slid up and down on the respective slide bars 25 on the end wall sections 11. Also, the side wall sections 12 are of the same height as the end wall sections 11.

Referring to FIG. 1, a suitable spring biased kick bar 30 can also be mounted on and between the end wall sections 11 to provide a means of locking a side wall section 12 in a raised vertical position (as shown). A suitable catch (not shown) is also provided on the kick bar 30 so that when the kick bar 30 is released, the side wall section 12 can be lowered. This construction is generally known and need not be further described.

The crib 10 is also provided with suitable mattress adjustment hooks 31 which are mounted on each end wall section 11 so as to receive mattress hangers 32 of a mattress frame 33. Again, this construction is generally known and need not be further described. A suitable mattress 34 is also mounted on the mattress frame 33 in known manner so as to be within the plane of the wall sections 11, 12.

The crib sections 11, 12 thus provide an enclosure for receiving an infant on the mattress 34. In this regard, apart from the frames which support the respective mesh panels, there are no rigid bars against which an infant may impact while laying on the mattress 34.

Referring to FIGS. 1 and 2, the crib 10 is also provided with a canopy 35 which is mounted on and between the end wall sections 11 over the crib enclosure. The canopy 35 is of an arch-shape and includes a pair of end frames 36 which are removably mounted on the respective end wall sections 11 by suitable means 37 and a pair of pivotally mounted sections 28 which are hinged about a common longitudinally disposed axis 39 via a pin connector 40.

As shown in FIG. 2, each end frame 36 is formed of a semicylindrical shaped frame 41, for example of plastic material, a mesh 42 which is disposed within and across the frame 41 and a strip 43, e.g. of vinyl, for securing the mesh 42 to the frame 41.

Figure 7:
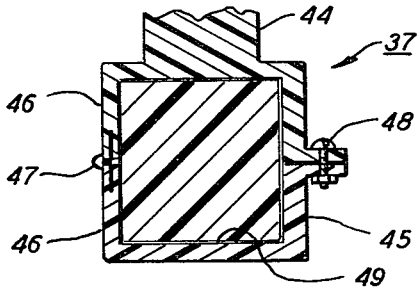
FIG. 7 illustrates a view taken on line 7—7 of FIG. 2.

The means 37 for mounting each end frame 36 on an end wall section 11 includes a pair of legs 44 which extend downwardly from the hemispherical frame 41 and a pair of clamps 45 for releaseably mounting about the upper bar of the frame 13 of the end wall section 11. As shown in FIG. 7, each clamp 45 is comprised of a pair of U-shaped members 46 one of which is integrally molded with a depending leg 44, a hinge 47 for hingedly mounting the two members 46 together and a means 48 in the form of a nut and bolt for locking the two members 46 together in a clamped manner about the frame 13 of the end wall section 11. In addition, a foam lining 49 can be provided between the frame 13 and the clamp members 46.

Each canopy section 38 is pivotally mounted at the upper end to pivot upwardly to an open position relative to the two stationary end frames 36 of the canopy 35. Each section 38 is also; of arcuate shape and is formed of a generally U-shaped frame 50, a mesh 51, and strip of material 52 for securing the mesh within and to the frame 50 in a manner similar to the above. The two pivotally mounted sections 38 are of a shape to complement the hemispherical shape of the end frames 36 of the canopy 35 as viewed from the end as in FIG. 2.

Figure 5:
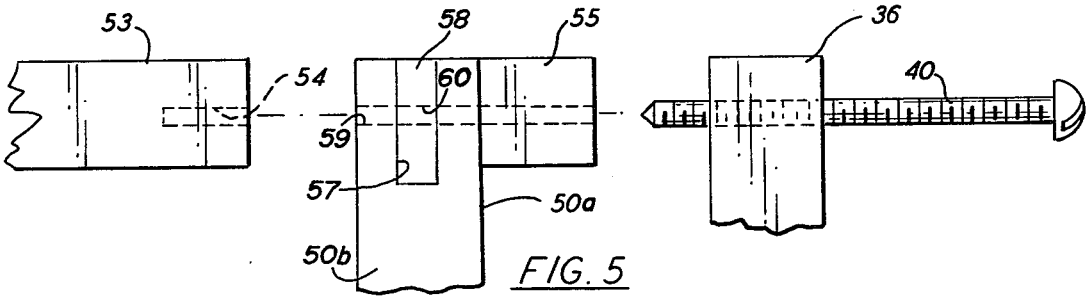
FIG. 5 illustrates an exploded view of a detail of the canopy construction in accordance with the invention.
Figure 6:
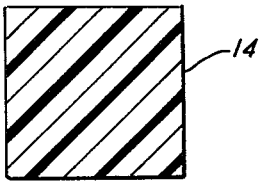
FIG. 6 illustrates a view taken on line 6—6 of FIG. 1.

Referring to FIG. 5, each U-shaped canopy frame 50 has two limbs 50*a*, 50*b* (FIG. 1). One limb 50*a* is bifurcated at the end to provide a slot 57 while the other limb 50*b* has a tongue 58 at the end to fit into a slot 57 of the opposed limb 50*a*. Also, each end of a limb is provided with a bore 59, 60 to receive the connector end 40, when aligned, after insertion of the tongue-containing end of a limb in the bifurcated end of the other limb. In addition, an elongated bar 53 extends between the respective interengaging ends of the two frames 50 and has a bore 54 at each end to receive a respective pin connector 40. A spacer 55 with a bore is also provided between each frame 36 and the interengaging ends of the two frames 50.

In addition, a spring assisted device (not shown) may be utilized at the top connection of the limbs of the frames 50 to allow an ease of movement as the arch shaped sections 38 are raised.

Each pivotally mounted section 38 of the canopy 35 is also provided with a suitable releaseable locking means 56 for releaseably locking the section 38 to at least one of the end frames 11. For example, the locking means 56 may be in the form of a pinch lock having a pair of spring biased tabs which can be pinched together against the force of a spring (not shown) and a pair of shafts (not shown) which are connected to the tabs to extend within bores in the frame 50 of the sections 38 into suitable bores (not shown) in the end frames 36. Thus, upon pinching together of the tabs, the bars slide out of the bores in the end frame so that the canopy section can be swung upwardly.

The arch-like sections of the canopy are disposed no more than 2⅜ inches from the end frames of the canopy.

Alternatively, an elastic fabric or membrane can be integrally stitched the length of the top bar 53 to the canopy mesh 51 and the strip of material 52. The resulting sandwich will provide a tension force along the top edge of the mesh 51 and subsequently assist in the raising of one or both canopy sections 38.

During use, the side wall sections 12 of the crib 10 can be dropped while the canopy 35 remains in place. Alternatively, one or both canopy sections 38 may be raised while the side wall sections 12 of the crib 10 remain fixed.

The invention thus provides a crib of a construction which reduces unnecessary hazards and inconveniences presented by various types of previously known cribs.

Further, the invention provides a crib which does not require crib bumpers as there are no bars from which to protect an infant. By eliminating the use of rigid bars on the side wall sections, the safety of the crib is improved. For example, the danger of an infant becoming wedged between inflexible bars is eliminated. Also, it becomes less likely that an infant standing on wobbly legs would strike a rigid bar upon falling inside the crib. Specifically, there are fewer rigid members for the infant to strike. In other words, all but the structural members are replaced with a mesh.

The canopy also reduces the possibility of a fall by providing a means to enclose the crib enclosure in a suitable attractive manner. Also, the canopy can preclude the danger of entrance into the crib by siblings or household pets. Further, by forming the canopy of similar construction to the remainder of the crib, there is no impedence to a flow of air into and through the crib enclosure.

The canopy can also be retro-fitted onto existing cribs. In this regard, the means for mounting the canopy on such a crib can be modified from that as illustrated so as to adapt to the existing crib construction.

The crib can be completely fabricated of plastic structural members in a manner to eliminate the potential hazard of toxic paint flakes or wood splinters. Further, once a plastic mold is produced, the potential cost of the crib contruction can be more effectively reduced. However, it is to be noted that the crib and canopy frame work can also be made of wood or metal materials.

What is claimed is:

1. A crib comprising a pair of end wall sections, each said end wall section having a pair of legs for supporting said end wall sections in an upstanding manner;

a pair of upstanding side wall sections, at least one of said side wall sections being movably mounted between said end wall sections to define an enclosure therewith, each said sidewall section including a rectangular frame and a mesh disposed across and within said frame in a taut manner and a canopy mounted on and between said end wall sections in vertically spaced relation to said side wall sections and over said enclosure, said canopy having at least one pivotally mounted section movable from a closed position over said enclosure to an open position to provide access to said enclosure.

2. A crib as set forth in claim 1 wheresaid canopy includes a pair of end frames removably mounted on said respective end wall sections, and wherein said pivotally mounted section includes a frame pivotally mounted between said end frames, a mesh disposed across and within said frame and means securing said mesh to said frame.

3. A crib as set forth in claim 2 which further comprises locking means for releaseably locking each said end frame to a respective end wall section.

4. A crib as set forth in claim 2 which further comprises a releaseable locking means for securing said pivotally mounted section to at least one of said end frames.

5. A crib as set forth in claim 1 wherein said canopy is arch-shaped.

6. A crib as set forth in claim 5 wherein said canopy includes a pair of said pivotally mounted sections disposed to pivot about a common hinge axis.

7. A crib as set forth in claim 1 wherein each end wall section includes a rectangular frame and a mesh disposed across and within said frame.

8. A crib as set forth in claim 1 wherein each end wall section includes a bar extending horizontally between said legs thereof for suspending accessories therefrom.

9. A crib as set forth in claim 1 wherein said one side wall section is vertically movable between said end wall sections.

10. A crib as set forth in claim 1 wherein each said frame is made of plastic and said mesh is made of plastic and which further includes at least one vinyl strip about said frame with an edge of said mesh inserted between and secured to overlying edges of said strip.

11. A crib comprising a pair of end wall sections, each said end wall section having a pair of legs for supporting said end wall sections in an upstanding manner;

a pair of side wall sections mounted between said end wall sections in an upstanding manner to define an enclosure therewith; and a canopy mounted on and between said end wall sections in vertically spaced relation to said side wall sections, and over said enclosure, said canopy having at least one pivotally mounted section movable from a closed position over said enclosure to an open position to provide access to said enclosure.

12. A crib as set forth in claim 11 wherein said canopy is arch-shaped.

13. A crib as set forth in claim 12 wherein said canopy includes a pair of said pivotally mounted sections disposed to pivot about a common hinge axis.

14. A crib comprising a pair of end wall sections, each said end wall section including a rectangular frame, a mesh disposed across and within said frame, and a pair of legs supporting said end wall sections in an upstanding manner;

a pair of side wall sections mounted between said end wall sections in an upstanding manner to define an enclosure therewith, each said side wall section including a rectangular frame and a mesh disposed across and within said frame; and a canopy mounted on and between said end wall sections in vertically spaced relation to said side wall sections, and over said enclosure, said canopy having at least one pivotally mounted section movable from a closed position over said enclosure to an open position to provide access to said enclosure, said pivotally mounted section including a frame and a mesh disposed across and within said frame.

15. A crib as set forth in claim 14 wherein said canopy includes a pair of said pivotally mounted sections disposed to pivot about a common hinge axis.

16. A crib as set forth in claim 15 wherein said canopy includes a pair of end frames, each said end frame being removably mounted on a respective end wall section and wherein each said pivotally mounted section is pivotally mounted on and between said end frames.

17. A crib as set forth in claim 14 wherein each frame is made of plastic.

18. A crib as set forth in claim 14 wherein each leg has a dual wheel assembly mounted on a lower end thereof.

19. A crib as set forth in claim 14 wherein said canopy includes a pair of end frames, each said end frame being removably mounted on a respective end wall section and wherein said pivotally mounted section is pivotally mounted on and between said end frames.

20. An arch-shaped canopy for a crib comprising a pair of semicylindrical shaped end frames;

means for removably mounting each end frame on an end wall section of a crib; and at least one arcuately-shaped section pivotally mounted on and between said end frames for movement from a closed position to an open position relative to said end frames, said arcuately-shaped section including a frame and a mesh disposed across and within said frame.

21. A canopy as set forth in claim 20 wherein said canopy includes a pair of said pivotally mounted sections disposed between said end frames to pivot about a common hinge axis.

22. A crib as set forth in claim 20 which further comprises a releaseable locking means for securing said arcuately shaped section to at least one of said end frames.

23. A crib comprising a pair of end wall sections, each said end wall section including a rectangular frame, a mesh disposed across and within said frame, and a pair of legs supporting said end wall sections in an upstanding manner;

a pair of side wall sections mounted between said end wall sections in an upstanding manner to define an enclosure therewith, each said side wall section including a rectangular frame and a mesh disposed across and within said frame; and an arch-shaped canopy mounted on and between said end wall sections over said enclosure, said canopy having a pair of end frames, each said end frame being removably mounted on a respective end wall section, a pair of pivotally mounted sections mounted on and between said end frames to pivot about a common hinge axis from a closed position over said enclosure to an open position to provide access of said enclosure, each said pivotally mounted section including a frame and a mesh disposed across and within said frame; and a releaseable locking means for securing said pivotally mounted section to at least one of said end frames.

* * * * *